US008541323B2

(12) United States Patent
Shimotsu et al.

(10) Patent No.: US 8,541,323 B2
(45) Date of Patent: Sep. 24, 2013

(54) SPLITTABLE CONJUGATE FIBER, AGGREGATE THEREOF, AND FIBROUS FORM MADE FROM SPLITTABLE CONJUGATE FIBERS

(75) Inventors: Yukiharu Shimotsu, Osaka (JP); Minoru Miyauchi, Osaka (JP); Kazuyuki Sakamoto, Osaka (JP)

(73) Assignees: ES Fibervisions Co., Ltd., Osaka (JP); ES Fibervisions Hong Kong Limited, Kowloon (HK); ES Fibervisions LP, Athens, GA (US); ES Fibervisions APS, Varde (DK)

( * ) Notice: Subject to any disclaimer, the term of this patent is extended or adjusted under 35 U.S.C. 154(b) by 874 days.

(21) Appl. No.: 12/601,439

(22) PCT Filed: May 23, 2008

(86) PCT No.: PCT/JP2008/059960

§ 371 (c)(1),
(2), (4) Date: Nov. 23, 2009

(87) PCT Pub. No.: WO2008/146898

PCT Pub. Date: Dec. 4, 2008

(65) Prior Publication Data

US 2010/0173154 A1 Jul. 8, 2010

(30) Foreign Application Priority Data

May 24, 2007 (JP) ..... 2007-137994

(51) Int. Cl.

| | |
|---|---|
| ***D04H 1/00*** | (2006.01) |
| ***D04H 3/00*** | (2012.01) |
| ***D04H 5/00*** | (2012.01) |
| ***D04H 13/00*** | (2006.01) |

(52) U.S. Cl.
USPC ..... 442/361; 442/362; 442/363; 442/364; 428/373

(58) Field of Classification Search
USPC ..... 442/361–364; 428/373
See application file for complete search history.

(56) References Cited

U.S. PATENT DOCUMENTS

| | | | |
|---|---|---|---|
| 4,361,609 | A | 11/1982 | Gerlach et al. |
| 6,465,095 | B1 | 10/2002 | Dugan |

FOREIGN PATENT DOCUMENTS

| | | |
|---|---|---|
| EP | 1 175 863 | 1/2002 |
| JP | 5-239717 | 9/1993 |
| JP | 2000-110031 | 4/2000 |
| JP | 3309181 | 5/2002 |

*Primary Examiner* — Lynda Salvatore
(74) *Attorney, Agent, or Firm* — Hamre, Schumann, Mueller & Larson, P.C.

(57) ABSTRACT

A splittable conjugate fiber comprising a polyester segment and a polyolefin segment, wherein the splittable conjugate fiber comprises two or more parts of the polyester segment extending from a center of the fiber toward an outer edge of the fiber in a cross-sectional configuration perpendicular to its longitudinal direction, in which at least one of the two or more parts of the polyester segment extending from the center of the fiber toward the outer edge of the fiber is exposed at the outer edge of the fiber and at least one of the two or more parts of the polyester segment extending from the center of the fiber toward the outer edge of the fiber is unexposed at the outer edge of the fiber.

6 Claims, 1 Drawing Sheet

SPLITTABLE CONJUGATE FIBER, AGGREGATE THEREOF, AND FIBROUS FORM MADE FROM SPLITTABLE CONJUGATE FIBERS

TECHNICAL FIELD

The present invention relates to a splittable conjugate fiber comprising a polyester and a polyolefin, which is excellent in thermal bondability to a polyolefin-based binder fiber or the like, splittability, and productivity; an aggregate of the splittable conjugate fibers; and a fibrous form made from the splittable conjugate fibers.

BACKGROUND ART

Use of conjugate fibers of a sea-island type or split type has conventionally been known as a technique for obtaining microfibers.

A method of obtaining a sea-island type conjugate fiber is to spin a combination of two or more ingredients. Removing one component of the resultant sea-island type conjugate fiber by dissolution gives microfibers. Although this technique can yield exceedingly fine fibers, it is not economical because one component is removed by dissolution.

On the other hand, a method of obtaining a splittable conjugate fiber is to spin a combination of two or more resins. The splittable conjugate fiber obtained is split into many fibers by applying a physical stress thereto or utilizing, e.g., a difference in contraction with a chemical between the resins. Thus, microfibers are obtained.

Known splittable conjugate fibers include those comprising two different polyolefins such as, e.g., disclosed in Patent document 1. The publication discloses a conjugate fiber comprising at least two polyolefin components and having a hollow in the center of the fiber in a cross-sectional configuration, in which the components are arranged radially and alternately, wherein a hollow ratio of the hollow is 5 to 40%, and a ratio of an average length W of an outer arc of the fiber to an average length L of from the hollow to the outer edge of the individual segments (W/L) is 0.25 to 2.5. The publication describes the splittable conjugate fiber as having excellent splittability. However, a polyolefin generally has a low melting point so that the polyolefin conjugate fiber is difficult to process and use at 160° C. or higher.

Patent document 2 discloses a splittable conjugate fiber, in which a polyester and a polyolefin are radially and alternately arranged into 8 or more segments in a cross-sectional configuration, which is easily splittable into microfibers providing nonwoven fabric with excellent softness and texture. The splittable conjugate fibers comprising the polyester and the polyolefin are easy to process and use at 160° C. or higher. However, when a loose aggregate of such splittable conjugate fibers, which is called a web, is subjected to physical impact such as high pressure water jets being generally conducted for splitting the splittable fibers as described in the publication, the fibers are liable to be shunted around a point of impact, resulting in easily forming holes or poor texture of the nonwoven fabric.

To address this problem, an approach has been developed, for example, when a nonwover fabric is produced using splittable conjugate fibers by an air-laid web method, the splittable conjugate fibers are blended with an ordinary olefin-based fiber as a binder fiber to thermally bond (fix) the splittable fibers via the binder fiber before application of physical impact for splitting.

Patent document 1: Japanese Patent 3309181

Patent document 2: JP-A-2000-110031

DISCLOSURE OF INVENTION

Technical Problem

However, the splittable conjugate fiber comprising the polyester and the polyolefin has less thermal bond strength between the fibers than a nonwoven fabric comprising a polyolefin-based splittable conjugate fiber and a polyolefin-based binder fiber, since the polyester having a low compatibility with a polyolefin-based binder fiber is exposed at an outer edge of the fiber. Therefore, the web of the splittable conjugate fibers is not so tough that the splittable fibers are easily debonded from each other by the impact such as a water jet. It still remains difficult to avoid holes being formed or poor texture of the resulting nonwoven fabric.

Besides the above problem, the poor compatibility between the polyester and the polyolefin has caused poor conjugate spinnability due to the difficulty encountered in stabilizing the fibrous state in conjugate melt spinning. This has been problematic from the standpoint of productivity.

An object of the present invention is to settle down the problems described above and to provide a splittable conjugate fiber comprising a polyester and a polyolefin, which is excellent in splittability, thermal bondability to a polyolefin-based binder fiber, and productivity (e.g., spinnability); an aggregate of the splittable conjugate fibers; and a fibrous form (e.g., nonwoven fabric) with excellent texture made from the splittable conjugate fibers.

Technical Solution

As a result of extensive investigations, the present inventors have found that the above problems are solved by the provision of a splittable conjugate fiber comprising a polyester segment and a polyolefin segment, wherein the splittable conjugate fiber comprises a plurality parts of the polyester segment extending from a center of the fiber toward an outer edge of the fiber in a cross-sectional configuration perpendicular to its longitudinal direction, in which one part of the polyester segment extending from the center of the fiber toward the outer edge of the fiber is exposed at the outer edge of the fiber and another part of the polyester segment extending from the center of the fiber toward the outer edge of the fiber is unexposed at the outer edge of the fiber, and by the provision of an aggregate comprising such splittable conjugate fibers in an appropriate proportion. The present invention has been completed based on these findings.

Namely, the present invention includes the following constitutions.

(1) A splittable conjugate fiber comprising a polyester segment and a polyolefin segment, wherein the splittable conjugate fiber comprises two or more parts of the polyester segment extending from a center of the fiber toward an outer edge of the fiber in a cross-sectional configuration perpendicular to its longitudinal direction, in which at least one of the two or more parts of the polyester segment extending from the center of the fiber toward the outer edge of the fiber is exposed at the outer edge of the fiber and at least one of the two or more parts of the polyester segment extending from the center of the fiber toward the outer edge of the fiber is unexposed at the outer edge of the fiber.

(2) The splittable conjugate fiber according to (1), which has a hollow.

(3) The splittable conjugate fiber according to (1) or (2), which has a value of W/R of 0.1 to 0.4, wherein W represents a length of an arc of the polyester segment and R represents a length of a circumference of the fiber.

(4) An aggregate of splittable conjugate fibers comprising polyester and polyolefin, which comprises the splittable conjugate fiber according to any one of (1) to (3) in a proportion of at least 25% based on the total number of the splittable conjugate fibers contained in the aggregate.

(5) A fibrous form comprising a microfiber having an average single-yarn fineness after splitting of 0.6 dtex or less, wherein the fibrous form is obtained by splitting the splittable conjugate fiber according to any one of (1) to (3) or the fiber contained in the aggregate of splittable conjugate fibers according to (4).

Advantageous Effects

The splittable conjugate fiber comprising a polyester and a polyolefin and an aggregate thereof of the present invention exhibit high thermal bondability to a polyolefin-based binder fiber as well as good splittability, and are therefore easy to split fibers to provide a fibrous form with high denseness and good texture.

EXPLANATION OF REFERENCE

1 A part of polyester segment exposed at an outer edge of the fiber

1' A part of polyester segment unexposed at a point lying within an outer edge of the fiber

2 Polyolefin segment

3 Hollow of splittable conjugate fiber r Distance between a center of the fiber and an outer edge of the polyester segment unexposed at the outer edge of the fiber d Distance between a center of the fiber and an outer edge of the fiber

BEST MODE FOR CARRYING OUT THE INVENTION

The present invention will be described in detail with reference to its preferred embodiments.

The splittable conjugate fiber of the invention comprises two components as described above, i.e. a polyester and a polyolefin.

Examples of the polyester that can be preferably used in the invention include polyethylene terephthalate, polybutylene terephthalate, polyhexylene terephthalate, polytrimethylene terephthalate, and polylactic acid. Polyethylene terephthalate is particularly preferred in terms of a production cost, a mechanical property, and a processability in splitting fibers.

Examples of the polyolefin that can be used in the invention include polyethylene, polypropylene, polybutene-1, polyoctene-1, an ethylene-propylene copolymer, and a polymethylpentene copolymer. Polypropylene is preferred in view of a production cost, a thermal property, and a processability in splitting fibers. Polypropylene having a Q value (mass average molecular weight/number average molecular weight) of 2 to 5 is still preferred in terms of spinnability and stretchability.

In producing the polyester and polyolefin, other ingredient may be copolymerized for the purpose of modification, e.g., for improving splittability or thermal bondability. Furthermore, various other kinds of polymers may be mixed, or various kinds of additives may be incorporated thereinto. For example, an inorganic pigment such as carbon black, chrome yellow, cadmium yellow, or iron oxide, or an organic pigment such as a disazo pigment, anthracene pigment, or phthalocyanine pigment can be incorporated for the purpose of coloring.

Figure 1:
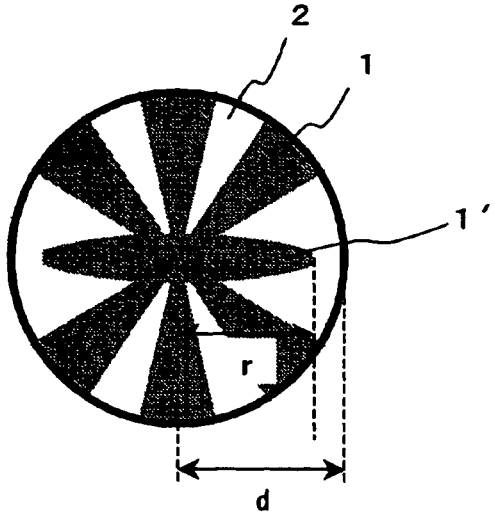
FIG. 1 is a schematic cross-section of an embodiment of the splittable conjugate fiber according to the invention.

FIG. 1 represents a sectional view showing an example of the splittable conjugate fiber of the invention. The splittable conjugate fiber has two or more parts of the polyester segment (1 and 1') extending from the center of the fiber toward the outer edge of the fiber in a cross-sectional configuration perpendicular to its longitudinal direction (hereinafter refer to as "convex portion"). These parts of the polyester segment interconnect each other at the center of the fiber to form a unitary polyester segment. Each polyester segment may not interconnect at the center of the fiber to be independent of each other, or some polyester segments may interconnect each other and others may be independent. The number of the convex portion should be 2 or more, and is preferably 4 to 16 in terms of spinnability and stretchability, and splittability. At least one of the convex portion is exposed at the outer edge on the surface of the fiber (represented by 1) while at least one of the convex portion is not exposed the outer edge on the surface of the fiber (represented by 1'). The regions isolated by the convex portions and the regions isolated by the surface of the fiber and the edges of the convex portions of polyester are a polyolefin segment (2) comprising a polyolefin. The presence of at least one part of the polyester segment exposed at the outer edge of the fiber ensures the splittability of the splittable conjugate fiber, resulting in good splittability when received a mechanical force. On the other hand, the presence of at least one part of the polyester segment unexposed at the outer edge of the fiber means the presence of a polyolefin segment at the fiber surface, resulting in ensuring the thermal bondability to a polyolefin-based binder fiber and providing improved thermal bond strength.

The aggregate of splittable conjugate fiber of the present invention preferably comprises the above described splittable conjugate fibers of the invention in a proportion of at least 25% based on the total number of splittable conjugate fibers contained in the aggregate. Both the splittability and thermal bondability to a binder fiber are easily satisfied in the presence of 25% or more of the above described splittable conjugate fiber of the invention. In order to reflect the above effects by the splittable conjugate fiber of the invention in the aggregate of fibers more assuredly, the proportion of the splittable conjugate fiber of the invention in the aggregate is more preferably 40% or more, and even more preferably 50% or more.

The aggregate of splittable conjugate fibers of the invention may contain other splittable conjugate fibers, such as those having all convex portions of a polyester segment exposed at the outer edge of the fiber and those having all convex portions of a polyester segment unexposed at the outer edge of the fiber.

The aggregate of splittable conjugate fibers of the invention is preferably such that arbitrarily chosen 10 fibers thereof have an average value of r/d of 0.75 to 0.99, particularly preferably 0.85 to 0.99 in terms of splittability and thermal bondability, wherein r represents a distance between an edge of the convex portion of the polyester segment and the center of the fiber, and d represents a distance between the center of the fiber and the outer edge of the fiber.

To secure splittability and thermal bondability as desired, the aggregate of splittable conjugate fibers of the invention is preferably such that arbitrarily chosen 10 fibers thereof have an average value of W/R of 0.1 to 0.4, more preferably 0.2 to 0.4, wherein W represents an average length of arcs of the polyester segment, and R represents a circumference length of the fiber and W/R indicates an exposure ratio of the polyester segment.

The aggregate of splittable conjugate fibers of the invention is preferably such that arbitrarily chosen 10 fibers thereof have an average ratio of the number of a convex portion of a polyester segment whose edge is unexposed at the outer edge of the fiber to the total number of a convex portion of a polyester segment, which will be referred to as an unexposure ratio of the polyester segment, of 10 to 90%, preferably 10 to 60%, in terms of splittability and thermal bondability.

The spinnability and stretchability, splittability being dependent on the exposure ratio of the polyester segment, and thermal bondability to a polyolefin-based binder fiber of the splittable conjugate fiber are adjustable by controlling, for example, an area ratio (Z) of the polyester segment in the cross-section perpendicular to the fiber longitudinal direction, an MFR of the polyolefin, a spinning temperature, and a solidification behavior of a molten resin.

Z is preferably 0.3 to 0.6. When Z is 0.3 or more, an amount of the polyester segment is relatively increasing, resulting in that the polyester segment is easy to be exposed at the outer edge of the fiber and an improved splittability is effectively secured. When Z is 0.6 or less, an amount of the polyester segment is relatively decreased, resulting in that excessive exposure of the polyester segment is controlled. That is, the amount of the polyolefin segment is relatively increased, resulting in that improved thermal bondability to a polyolefin binder fiber is easily ensured. Z of 0.6 or less is also advantageous in that the fiber is cooled properly and thereby prevented from troubles during spinning such as fiber breaks.

When the MFR of the polyolefin decreases, the exposure of the polyester segment tends to increase. When the MFR of the polyolefin increases, the exposure of the polyester segment tends to decrease. To accomplish the object of the invention, it is preferred to use a polyolefin having the MFR of 10 to 80 g/10 min, more preferably 15 to 40 g/10 min. When the polyolefin has the MFR of 10 to 80 g/10 min, it is preferred in terms of decreasing troubles during spinning such as fiber breaks and a break of the fiber during stretching.

The solidification behavior of the molten resin is controllable by adjusting, for example, a cooling air velocity in cooling the molten resin immediately after being spun. When cooling is too strong, the time required for covering the polyester segment in the molten resin, which is discharged from a spinning nozzle, with the polyolefin is not sufficiently secured. It tends to follow that the resulting fiber has a high exposure ratio of the polyester segment. When cooling is too weak, spinnability tends to be deteriorated. For these considerations, the molten resin is preferably cooled by applying cooling air at a temperature of 10 to 30° C. at a velocity of 1 to 2 m/sec.

In the present invention, Z is preferably more than W/R in terms of thermal bondability. More preferably, Z and W/R are related such that $2.1\times(W/R)>Z>1.1\times(W/R)$. The shape of a convex portion of the polyester segment is not particularly limited and may be a daisy petal, a trumpet, a wedge or the like. A single fiber may have a combination of these shapes of the convex portion.

The number of the convex portion should be 2 or more. It is preferably 4 to 16, more preferably 6 to 10, to secure splittability and to obtain a fine fiber after splitting.

The splittable conjugate fiber of the invention preferably has a single-yarn fineness of 1 to 15 dtex (decitexes). When the single-yarn fineness is 1 dtex or more, the target sectional state is obtained easily, and the amount of the molten resin discharged from a single orifice of a spinning nozzle is sufficient to avoid instability of the discharged molten resin stream and to secure good spinnability and stretchability. As long as the single-yarn fineness is 15 dtex or less, the amount of the molten resin discharged from the single orifice of the spinning nozzle is not too large to result in insufficient cooling of the filament and resultant draw resonance. As a result, the spinnability and stretchability tends not to decrease.

The splittable conjugate fiber may have a circular or elliptic cross-section or a modified cross-section such as polygonal (e.g., triangular to octagonal). An average single-yarn fineness after splitting is preferably 0.6 dtex or less, more preferably 0.5 dtex or less. When the average single-yarn fineness after splitting is 0.6 dtex or less, a fibrous form having an even and satisfactory texture, which is the greatest characteristic in the splittable conjugate fiber, is obtained through splitting fibers.

Figure 2:
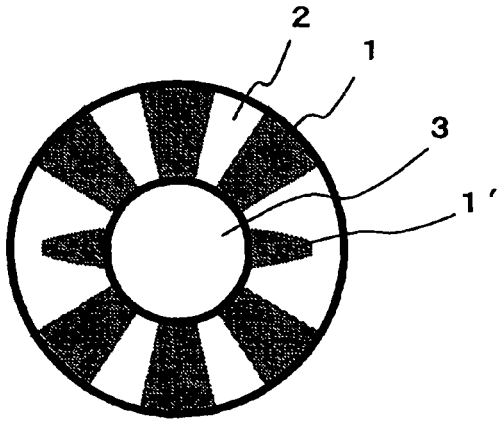
FIG. 2 is a schematic cross-section of another embodiment of the splittable conjugate fiber according to the invention, which is a fiber having a hollow.

The splittability of the splittable conjugate fiber of the invention is improved by having a hollow, desirably in the center thereof. FIG. 2 represents a cross-section view illustrating embodiment of the splittable conjugate fiber having a hollow which is used in the invention. The shape of the hollow may be any of circular, elliptical, triangular, quadrangular, and other shapes. The proportion of the hollow is preferably 1 to 40%, more preferably 5 to 30%. When the proportion thereof is 1% or higher, contact between adjoining convex portions on the fiber center side and the area of the contact are reduced and this enables the unsplit fiber to be readily crushed when split fibers by physical stress. In this case, low energy suffices to separate the two components at the contact interface between these. Namely, the presence of a hollow is apt to produce the effect of improving splittability. The proportions of the hollow of 40% or lower are more preferred because spinnability is maintained and high productivity can be realized while maintaining reduced contact and a reduced area of contact between adjoining convex portions and maintaining a desired level of splitting fibers by physical stress.

In order to obtain the splittable conjugate fiber with a uniform diameter of the fiber after splitting, it is preferred that at least one convex portion which is unexposed makes a pair with another convex portion which is part of segment extending from the center of the fiber toward the outer edge of the fiber in opposite directions. It is more preferred that one convex portion which is unexposed at the outer edge of the fiber makes a pair with another convex portion which is a part of segment extending from the center of the fiber to a point lying within the outer edge of the fiber in opposite directions and is unexposed at the fiber surface in all convex portions of the segment. Such a cross-sectional configuration is obtained by controlling the resin stream in a spinning nozzle.

A process of producing an aggregate of splittable conjugate fibers comprising a splittable conjugate fiber which is a combination of a polyethylene terephthalate resin and a polypropylene resin will then be described as one embodiment of the aggregate of splittable conjugate fibers comprising the splittable conjugate fiber of the invention. In producing this splittable conjugate fiber, the known melt conjugate spinning process is used to spin the resins. The resultant filament is cooled with blowing air by means of a known cooler such as lateral blowing or circular blowing. Thereafter, a surfactant is applied to the cooled filament to obtain an unstretched yarn through a draw-off roller.

A spinning nozzle for known splittable conjugate fibers may be used. A spinning temperature is especially important from the standpoint of optimizing the fiber sectional shape and the exposure degree of the polyester segment. Specifically, the spinning temperature is preferably 200 to 330° C., more preferably 220 to 260° C. A speed of the draw-off roller is preferably 500 to 2000 m/min. Two or more such unstretched yarns thus obtained are bundled and subjected to stretching with a known stretching machine between rollers differing in peripheral speed. Multistage stretching may be conducted according to need. The stretch ratio may be in the range of generally about from 2 to 5. Subsequently, the stretched tow was crimped with a push-in type crimper according to need and then cut into a given fiber length to obtain short fibers. The process steps shown above are ones for producing short fibers. However, without being cut, the long-fiber tow may be treated with, e.g., a yarn-dividing guide to obtain a web. Thereafter, the fibers are subjected to higher-order processing steps according to need and then formed into a fibrous form according to any of various applications. It is also possible to use a method in which the filament obtained through spinning and stretching is rolled up as a filament yarn and this yarn is knitted or woven to obtain a fibrous form as a knitted or woven article. Alternatively, use may be made of a method in which the short fibers are formed into a spun yarn and this yarn is knitted or woven to obtain a fibrous form as a knitted or woven article.

The term "fibrous form" as used herein is intended to include any forms of fabric, such as woven fabric, knitted fabric, nonwoven fabric, and nonwoven fiber aggregates. In addition, the fibers may be formed into a fabric by a technique such as fiber blending, mix spinning, filament combination, co-twisting, union knitting, union weaving, or the like. Examples of the nonwoven fiber aggregates include web-form even products obtained by a carding process, an airlaying process, a papermaking process or the like, and multilayered products obtained by laminating one or more of woven fabrics, kitted fabrics, and nonwoven fabrics to such a web-form product.

After the splittable conjugate fiber of the invention, which makes up the aggregate of splittable conjugate fibers is obtained through spinning in the manner described above, a surfactant may be adhered thereto for the purpose of, e.g., static protection of the fiber or imparting surface smoothness for improving processing property. The kind and concentration of the surfactant may be suitably regulated according to applications. For the adhesion method, use may be made of a roller method, immersion method, padding-and-drying method, or the like. The adhesion is not limited in the spinning step described above, and the adhesion may be performed in either of the stretching step or the crimping step. Furthermore, regardless of whether the fiber is a short fiber or a long fiber, a surfactant may be adhered thereto in a stage other than the spinning step, stretching step, and crimping step, such as, e.g., after the formation of a fibrous form.

The fiber length of the splittable conjugate fiber of the invention is not particularly limited. However, in the case of producing a web using a carding machine, fibers of 20 to 76 mm are generally used. In the case of the papermaking process or airlaying process, it is generally preferred to use fibers of 20 mm or shorter. In case of using a carding machine, fibers largely exceeding 76 mm are difficult to form a uniform web and also difficult to form with a web with good texture.

The splittable conjugate fiber of the invention is applicable to various processes for fibrous-form production including the airlaying process. Processes for producing a nonwoven fabric are shown as examples. For example, the short fibers obtained from the splittable conjugate fiber described above are used to produce a web having a necessary basis weight by the carding, airlaying, or papermaking process. Alternatively, a web may be directly produced by a melt-blowing process, spun-bonding process, or the like. The web produced by the above method can be subjected to fiber splitting into microfibers by a known method such as, e.g., the needle punching method or high-pressure liquid jet treatment, whereby a fibrous form can be obtained. It is also possible to treat this fibrous form by a known processing technique with hot air or a heated roll.

While, as stated, the splittable conjugate fiber of the invention can be processed into fibrous forms according to various applications, it is particularly effective in that an entanglement of the fibers in an air laying process or a papermaking process or a like force exerted on each other is too weak to be contributory to shape retention of the web. When a web formed with very short fibers by the air laying or papermaking process is subjected to a known fiber splitting operation such as needle punching or high pressure liquid jet treatment, the fibers are not only split but also moved by the physical stress applied, resulting in the formation of holes or poor texture of the web. The insufficient entanglement of the fibers also causes the web to lose its shape or be flipped up while being transferred after the web formation. To avoid such troubles it is a generally followed practice to blend the splittable conjugate fiber with a binder fiber that are fusible at lower temperatures than the melting point of the resins making up the splittable conjugate fibers. The web comprising the binder fibers in addition to the splittable fibers is once heat treated to temporarily bind the splittable fibers with the binder fibers and then forwarded to the step of splitting where the splittable fibers are split into fine fibers, e.g., by high pressure liquid jet treatment. Since the splittable conjugate fibers are temporarily fixed via the binder fiber prior to the splitting operation, the resulting nonwoven fabric has better texture than the nonwoven fabric obtained from a conventional polyester/polyolefin splittable conjugate fiber. Furthermore, the transfer stability in the steps for the production of nonwoven fabric comprising microfibers is improved by using the splittable conjugate fiber of the invention. The splittable conjugate fiber of the invention is particularly advantageous in that the temporary fixation can be accomplished with reduced heat energy because it exhibits high thermal bondability to a polyolefin-based binder fiber which generally has a low melting point and is therefore fusible at low temperatures. In the case where, for example, the polyolefin component of the splittable conjugate fiber of the invention is polypropylene, a high density polyethylene-based binder fiber having a lower melting point than polypropylene may be used as a binder fiber. Temporary fixation of the splittable conjugate fiber can be performed by heat treating at a higher temperature than the melting point of the resin of the binder fiber and lower than the melting point of the polyolefin component constituting the splittable conjugate fiber. The splittable conjugate fiber of the invention may be fixed temporarily without the aid of a binder fiber by heating the splittable conjugate fiber at or above the melting point of any one of the resin components constituting the splittable conjugate fiber to cause the component to soften and melt. In that case, nevertheless, the splittable conjugate fiber hardly maintains their initial form after the resin component thereof softens and melts to adhere to each other. In the case when the binder fiber is used, since the web is heated at a temperature at which only the binder fiber soften and melt, and, as a result, the splittable conjugate fiber is fixed via the softened and molten binder fiber, the splittable conjugate fiber maintains their initial fiber form even after being temporarily fixed. That is, the splittable conjugate fiber temporarily fixed to each other retains the splittability as initially designed without deteriorating. It is preferable that the splittable conjugate fiber is blended with a binder fiber in the present invention. The binder fiber to be used is preferably composed of a resin component having a melting point lower than that of the polyolefin component of the splittable conjugate fiber by at least 20° C., more preferably by 30 to 100° C.

The effects of the present invention are manifested most pronouncedly when in using a polyolefin fiber as a binder fiber. However, this is not meant to exclude use of other binder fibers. Examples of other binder fibers that may be used include high-density polyethylene, low-density polyethylene, ethylene copolymerized polypropylene, ethylene butene-1 copolymerized polypropylene, polystyrene, and polypentene, provided that their melting point is preferably lower than that of the polyolefin component of the splittable conjugate fiber by at least 20° C. The binder fiber may be a conjugate fiber having a sheath core, a sea island, a multilayered or a like configuration. Examples of preferred conjugate fibers as a binder fiber are a polypropylene/high-density polyethylene-based sheath-core type conjugate fiber, a polypropylene/ethylene copolymerized polypropylene-based sheath-core type conjugate fiber, a polypropylene/ethylene-butene-1 copolymerized polypropylene-based sheath-core type conjugate fiber, and a polyester/high-density polyethylene-based sheath-core type conjugate fiber.

A basis weight of the fibrous form of the invention is not particularly limited. However, the fibrous form having a basis weight of 10 to 200 g/m$^2$ can be suitably used. When the fibrous form has a basis weight of less than 10 g/m$^2$, a nonwoven fabric may be formed with poor texture on being subjected to a splitting fibers operation with a physical stress such a sa high pressure liquid jet. When the fibrous form has a bases weight of more than 200 g/m$^2$, an increased pressure of the liquid jet is required due to high basis weight, tending to result in non-uniform splitting only to provide nonwoven fabric with poor texture.

The fibrous form of the invention may be a mixture of the splittable conjugate fiber of the invention and other fibers and powders according to need, as long as this does not lessen the effects of the invention. Examples of such optional fibers include synthetic fibers such as polyamide, polyester, polyolefin, and acrylic, natural fibers such as cotton, wool, and hemp, regenerated fibers such as rayon, cupra, and acetate, and semisynthetic fibers. Examples of the powders include natural-derived substances, such as pulverized pulp, leather powder, bamboo charcoal powder, wood charcoal powder, and agar powder, synthetic polymers such as water-absorbing polymers, and inorganic substances such as iron powder and titanium oxide.

Methods for splitting the splittable conjugate fiber of the invention are not particularly limited. Examples thereof include methods such as a needle punching method and high-pressure liquid jet treatment. The method of splitting by the high-pressure liquid jet treatment is explained here as an example. As an apparatus for the high-pressure liquid jet treatment, use may be made of an apparatus having many ejection holes with a diameter of, e.g., 0.05 to 1.5 mm, especially 0.1 to 0.5 mm, arranged at an interval of 0.1 to 1.5 mm in one or more rows. High-pressure liquid jets obtained by ejecting a liquid from the ejection holes at a high water pressure are caused to collide against the web or nonwoven fabric placed on a porous supporting member. Thus, the unsplit splittable conjugate fiber of the invention is entangled and simultaneously split into finer fibers by the high-pressure liquid jets. The rows of the ejection holes are arranged in a raw in perpendicular to the web travel direction. As the high-pressure liquid jets, use may be made of ordinary-temperature one or warm water or any other desired liquid. The distance between the array of ejection holes and the web or nonwoven fabric is preferably 10 to 150 mm. When that distance is smaller than 10 mm, there are cases where this treatment yields a fibrous form having a disordered texture. On the other hand, when that distance exceeds 150 mm, there are cases where the physical impact of the liquid jets on the web or nonwoven fabric is weak and the entanglement and fiber splitting into finer fibers is not sufficiently undergo. Pressure in this high-pressure liquid jet treatment is regulated according to the production process and the performances required of the fibrous form. However, it is generally preferred to eject high-pressure liquid jets at a pressure of 2 to 20 MPa. A method may be used in which the web or nonwoven fabric is treated in such a manner that the pressure of the high-pressure liquid jets increases successively from a low water pressure to a high water pressure within the above treatment pressure range, although that range depends on the basis weight being treated, etc. This method is less apt to disorder the texture of the web or nonwoven fabric and can attain entanglement and splitting into finer fibers. The porous supporting member on which the web or nonwoven fabric is placed in the treatment with high-pressure liquid jets is not particularly limited as long as it enables the high-pressure liquid jets to pass through the web or nonwoven fabric. For example, a metallic or synthetic-resin mesh screen of 50 to 200 mesh or a perforated plate may be used. Incidentally, use may be made of a method which comprises subjecting the web or nonwoven fabric to a high-pressure liquid jet treatment from one side, subsequently reversing the entangled web or nonwoven fabric, and subjecting it to the high-pressure liquid jet treatment. This method can yield a fibrous form in which both the front and back sides are dense and have a satisfactory texture. After the high-pressure liquid jet treatment, water is removed from the fibrous form which is obtained after treatment. For this water removal, known methods can be employed. For example, a squeezer such as a mangle is used to remove water in some degree and a drying apparatus such as a circulating hot-air drying apparatus is then used to completely remove water, whereby a fibrous form of the invention can be obtained.

If desired, the aggregate of splittable conjugate fibers of the invention may comprise another fiber as long as the effects of the invention are not ruined. Examples of the another fiber includes, but are not limited to, a splittable conjugate fiber other than that of the invention, a thermal-bondable conjugate fiber based on polypropylene/high-density polyethylene, a thermal-bondable conjugate fiber based on polypropylene/ethylene-copolymerized polypropylene, a thermal-bondable conjugate fiber based on polypropylene/ethylene-butene-1 copolymerized polypropylene, a thermal-bondable composite fiber based on a polyester/high-density polyethylene, a polyester fiber, a polyolefin fiber, and a rayon.

The web or nonwoven fabric obtained by splitting the splittable conjugate fibers of the invention has a good texture, high strength, and excellent splittability and is well suited for use as various filters, a battery separator, an artificial leather, a member for a hygienic article, and the like.

EXAMPLE

The invention will be explained below in detail by reference to Examples. However, the invention should not be limited thereto. Methods used for determining property values shown in the Examples or the definitions of the properties are shown below.

(1) Single-Yarn Fineness

Measurement was made in accordance with JIS-L-1015.

(2) Single-Yarn Strength and Elongation

Measurement was made with Autograph AGS 500D, manufactured by Shimadzu Corp., in accordance with JIS-L-1017 under the conditions of a sample length of 100 mm and a tensile rate of 100 mm/min.

(3) Melt Flow Rate Rate (MFR)

Measurement was made in accordance with JIS-K-7210.

Raw-material polypropylene resin: conditions 14

(4) Limiting Viscosity (IV)

Measurement was made with an Ubbellohde viscometer at 20° C. (in a 1:1 (by mass ratio) mixed solvent of phenol and tetrachloroethane).

(5) Spinnability

Stringiness when melt spinning was evaluated in the following four grades in terms of the number of filament breaks which occurred.

A: No filament break occurs and operation is satisfactory.

B: One or two filament breaks occur per hour.

C: Three or four filament breaks occur per hour.

D: Five or more fiber breaks occur per hour, which is problematical for spinning operation.

(6) Stretch Ratio

Stretch ratio was calculated using the following equation.

Stretch ratio=[draw-off roll speed (m/min)]/[feed roll speed (m/min)]

(7) Treatment with High Pressure Liquid Jets

A web formed on a roller carding machine, an air laying machine, a papermaking machine or the like was placed on an 80 mesh plain woven conveyer belt and was passed through under a nozzle having a diameter of 0.1 mm and a pitch of 1 mm, and water was jetted at high pressure. The running speed of the conveyer belt was 20 m/min. The high pressure water jet treatment consisted of two stages under the water jets at a pressure of 3 MPa as pretreatment, followed by four stages at a given water pressure. The web was then reversed and subjected to four stages treatment under the water jets at the same water pressure.

(8) Splittability (Air Permeability)

A web formed by the air laying machine was treated with high pressure liquid jets and dried at 25° C. for 48 hours. The air permeability of the web was measured in accordance with JIS-L-1096 method 6.27 A. With the basis weight of the web and the treating time being equal, a lower air permeability of the web is considered to indicate excellent splittability of the splittable conjugate fibers.

(9) Texture

Ten panelists examined a nonwoven fabric (1 m square) which had undergone fiber splitting into finer fibers. The fabric was visually examined for fiber distribution unevenness, and the results were judged based on the following criteria.

A: At least seven panelists felt that the fabric had little unevenness and no through-holes.

B: Four to six panelists felt that the fabric had little unevenness and no through-holes.

C: The number of panelists who felt that the fabric had little unevenness was 3 or smaller.

(10) Unexposure Ratio (%)

The polyester segment of ten splittable conjugate fibers arbitrarily chosen from an aggregate of the splittable conjugate fibers was examined, and the ratio of the convex portion of the polyester segment was calculated according to the following equality based on averages of the ten fibers.

Unexposure ratio (%)=(number of convex portion of polyester segment/total number of convex portion of polyester segment)×100

Examples 1 and 2

Polyethylene terephthalate having a melting point of 260° C. as a polyester component and polypropylene having a melting point of 160° C. and an MFR of 16 in Example 1 or polypropylene having a melting point of 160° C. and an MFR of 30 in Example 2 as a polyolefin component were spun at a spinning temperature of 280° C. through a spinning nozzle for a splittable conjugate fiber. The resin discharged from the spinning nozzle was cooled with cooling air of 25° C. at a wind velocity of 1.7 m/sec to obtain an aggregate of splittable conjugate fibers. The aggregate of splittable conjugate fibers had a polyester/polyolefin volume ratio of 50/50 and a single-yard fineness of 5.4 dtex. The aggregate of splittable conjugate fibers comprises the splittable conjugate fiber having a cross-sectional configuration representatively illustrated in FIG. 2, in which at least one convex portion of the polyester segment is exposed at the outer edge of the fiber and at least one convex portion of the polyester segment is unexposed at the outer edge of the fiber, in a proportion of 70% in Example 1 or in a proportion of 80% in Example 2. An alkyl phosphate potassium salt was adhered to the fibers in a draw-off step. The unstretched yarn obtained was stretched at 90° C. in a ratio of 1.8, and a dispersant for papermaking was adhered thereto. The yarn was then cut into a length of 5 mm. The total number of the convex portion of polyester segment was 8, and r/d was 0.95 in Example 1 or 0.96 in Example 2. The convex portion of the polyester segment which is unexposed at the outer edge of the fiber made a pair with a part of the polyester segment which extends from the center of the fiber toward the outer edge of the fiber in an opposite direction in a proportion of 20% (Example 1) or in a proportion of 33% (Example 2).

The short fibers obtained were blended with a binder fiber at a mass ratio of 70:30. The binder fiber was a sheath/core type conjugate fiber having a high density polyethylene having a melting point of 130° C. as a sheath and a polypropylene having a melting point of 160° C. as a core at a volume ratio of 50:50. The blended fiber was subjected to the air laid machine to form a web, and the web was heat treated at 138° C. for 0.3 minutes in the through-air bonding system thereby to temporarily bond to form a nonwoven fabric. The nonwoven fabric was then treated with high pressure liquid jets in the manner described above to obtain a fibrous form of the invention. The physical properties of the fiber and the fibrous form are shown in Table 1.

Example 3

Polyethylene terephthalate having a melting point of 260° C. as a polyester component and polypropylene having a melting point of 160° C. as a polyolefin component were spun at a spinning temperature of 280° C. through a spinning nozzle for a splittable conjugate fiber. The resin discharged from the spinning nozzle was cooled with cooling air of 25° C. at a wind velocity of 1.7 msec to obtain an aggregate of splittable conjugate fibers. The aggregate of splittable conjugate fibers had a polyester/polyolefin volume ratio of 50/50 and a single-yard fineness of 5.4 dtex. The aggregate of splittable conjugate fibers comprises the splittable conjugate fiber having a cross-sectional configuration representatively illustrated in FIG. 2, in which at least one convex portion of the polyester segment is exposed at the outer edge of the fiber and at least one convex portion of the polyester segment is unexposed at the outer edge of the fiber, in a proportion of 80%. The MFR of the polypropylene was 36. An alkyl phosphate potassium salt was adhered to the fibers in a draw-off step. The unstretched yarn obtained was stretched at 90° C. in a ratio of 1.8, and a dispersant for papermaking was adhered thereto. The yarn was then cut into a length of 5 mm. The total number of the convex portion of polyester segment was 8 and r/d was 0.94. The convex portion of the polyester segment which is unexposed at the outer edge of the fiber made a pair with a part of polyester segment which extends from the center of the fiber toward the outer edge of the fiber in an opposite direction in a proportion of 44%.

The short fibers obtained were subjected to the splitting treatment as same in Examples 1 and 2 to obtain the fibrous form of the present invention. The physical properties of the fiber and the fibrous form are shown in Table 1.

Example 4

Polyethylene terephthalate having a melting point of 260° C. as a polyester component and polypropylene having a melting point of 160° C. as a polyolefin component were spun at a spinning temperature of 280° C. through a spinning nozzle for a splittable conjugate fiber. The resin discharged from the spinning nozzle was cooled with cooling air of 25° C. at a wind velocity of 1.7 m/sec to obtain an aggregate of splittable conjugate fibers. The aggregate of splittable conjugate fibers had a polyester/polyolefin volume ratio of 40/60 and a single-yard fineness of 5.4 dtex. The aggregate of splittable conjugate fibers comprises the splittable conjugate fiber having a cross-sectional configuration representatively illustrated in FIG. 2, in which at least one convex portion of the polyester segment is exposed at the outer edge of the fiber and at least one convex portion of the polyester segment is unexposed at the outer edge of the fiber, in a proportion of 95%. The MFR of the polypropylene was 30. An alkyl phosphate potassium salt was adhered to the fibers in a draw-off step. The unstretched yarn obtained was stretched at 90° C. in a ratio of 1.8, and a dispersant for papermaking was adhered thereto. The yarn was then cut into a length of 5 mm. The total number of the convex portion of polyester segment was 8 and r/d was 0.91. The convex portion of the polyester segment which is unexposed at the outer edge of the fiber made a pair with a part of the polyester segment which extends from the center of the fiber toward the outer edge of the fiber in an opposite direction in a proportion of 76%.

The short fibers obtained were subjected to the splitting treatment as same in Examples 1 and 2 to obtain the fibrous form of the present invention. The physical properties of the fiber and the fibrous form are shown in Table 1.

Example 5

Polyethylene terephthalate having a melting point of 260° C. as a polyester component and polypropylene having a melting point of 160° C. as a polyolefin component were spun at a spinning temperature of 280° C. through a spinning nozzle for a splittable conjugate fiber. The resin discharged from the spinning nozzle was cooled with cooling air of 25° C. at a wind velocity of 1.7 m/sec to obtain an aggregate of splittable conjugate fibers. The aggregate of splittable conjugate fibers had a polyester/polyolefin volume ratio of 60/40 and a single-yard fineness of 5.4 dtex. The aggregate of splittable conjugate fibers comprises the splittable conjugate fiber having a cross-sectional configuration representatively illustrated in FIG. 2, in which at least one convex portion of the polyester segment is exposed at the outer edge of the fiber and at least one convex portion of the polyester segment is unexposed at the outer edge of the fiber, in a proportion of 60%. But unlike FIG. 2, a pair of convex portions of polyester segment was not always symmetric about the center of the fiber in the cross section of the fiber: in a pair of the convex portions of the polyester segment in which each of the convex portion extends from the center of the fiber toward the outer edge of the fiber in an apposite direction, at least one of convex portions was frequently exposed at the outer edge of the fiber. The MFR of the polypropylene was 30. An alkyl phosphate potassium salt was adhered to the fibers in a draw-off step. The unstretched yarn obtained was stretched at 90° C. in a ratio of 1.8, and a dispersant for papermaking was adhered thereto. The yarn was then cut into a length of 5 mm. The total number of the convex portion of polyester segment was 8 and r/d was 0.97.

The short fibers obtained were subjected to the splitting treatment as same in Examples 1 and 2 to obtain the fibrous form of the present invention. The physical properties of the fiber and the fibrous form are shown in Table 1.

Example 6

Polyethylene terephthalate having a melting point of 260° C. as a polyester component and polypropylene having a melting point of 160° C. as a polyolefin component were spun at a spinning temperature of 280° C. through a spinning nozzle for a splittable conjugate fiber. The aggregate of splittable conjugate fibers had a polyester/polyolefin volume ratio of 50/50 and a single-yard fineness of 5.4 dtex. The aggregate of splittable conjugate fibers comprises the splittable conjugate fiber having a cross-sectional configuration representatively illustrated in FIG. 2, in which at least one convex portion of the polyester segment is exposed at the outer edge of the fiber and at least one convex portion of the polyester segment is unexposed at the outer edge of the fiber, in a proportion of 20%. The solidification behavior of the molten resin was controlled by cooling with air at a 34% increased velocity relative to Example 1, whereby the unexposed ratio of the polyester segment reduced to 9% while the cross-sectional configuration conformed to FIG. 2. Fiber breaks occurred, which were considered ascribable to the low melt tension, while it was not very clear. That is, the spinnability tended to be reduced compared with Examples 1 to 5. The unstretched yarn obtained was stretched at 90° C. in a ratio of 1.8 and a dispersant for papermaking was adhered thereto. The yarn was then cut into a length of 5 mm. The amount of the fiber obtained was smaller than in Examples 1 to 5 due to the tendency to reduced spinnability. The total number of the convex portion of the polyester segment was 8, and r/d was 0.99. The convex portion of the polyester segment which is unexposed at the outer edge of the fiber made a pair with a pair of the polyester segment which extends from the center of the fiber toward the outer edge of the fiber in an opposite direction in a proportion of 57%.

The short fibers obtained were subjected to the splitting treatment as same in Examples 1 and 2 to obtain the fibrous form of the present invention. The physical properties of the fiber and the fibrous form are shown in Table 1.

Because of the small proportion (20%) of the splittable conjugate fibers having a cross-sectional configuration in which at least one of the polyester segments extends to an outer edge of the fiber and at least one of the polyester segments extends to a point lying within the outer edge of the fiber, the temporary fixability was inferior more or less, and the nonwoven fabric obtained after splitting had a less texture compared with those obtained in Examples 1 to 6 (i.e. the spinnability was "C").

Comparative Example 1

Polypropylene having a melting point of 160° C. and high density polyethylene having a melting point of 130° C. were spun at a spinning temperature of 280° C. through a spinning nozzle for a splittable conjugate fiber and cooled with cooling air of 25° C. at a wind velocity of 1.7 m/sec to obtain an aggregate of splittable conjugate fibers which did not comprise a polyester. The aggregate of splittable conjugate fibers had a polypropylene/polyethylene volume ratio of 50/50 and a single-yarn fineness of 5.4 dtex The aggregate of splittable conjugate fiber comprises the splittable conjugate fiber having a cross-sectional configuration representatively illustrated in FIG. 2, in which at least one convex portion of the polypropylene segment is exposed at the outer edge of the fiber and at least one convex portion of the polypropylene segment is unexposed at the outer edge of the fiber, in a proportion of 60%. But unlike FIG. 2, a pair of convex portions of polyester segment was not always symmetric about the center of the fiber in the cross section of the fiber: in a pair of the convex portions of the polyester segment in which each of the convex portion extends from the center of the fiber toward the outer edge of the fiber in an apposite direction, at least one of convex portions was frequently exposed at the outer edge of the fiber. The unstretched yarn obtained was stretched at 90° C. in a ratio of 4.3, and a dispersant for papermaking was adhered thereto. The yarn was then cut into a length of 5 mm.

The short fibers obtained were subjected to the splitting treatment as same in Examples 1 and 2 to obtain the fibrous form of the present invention. The total number of the convex portions thereof was 8 and r/d was 0.99.

The physical properties of the fiber and the fibrous form are shown in Table 1. The spinnability was good and the texture of the fabric form is good. However, the fabric form had high air permeability, proving poor splittability.

TABLE 1

| | Example 1 | Example 2 | Example 3 | Example 4 | Example 5 | Example 6 | Comp. Example 1 |
|---|---|---|---|---|---|---|---|
| Spinning/Stretching Conditions | | | | | | | |
| Resin kind I | PET | PET | PET | PET | PET | PET | PP |
| Limiting Viscosity | 0.64 | 0.64 | 0.64 | 0.64 | 0.64 | 0.64 | (MFR: 10) |
| Resin kind II | PP | PP | PP | PP | PP | PP | HDPE |
| MFR | 16 | 30 | 36 | 30 | 30 | 16 | 17 |
| Cross-sectional Configuration | hollow split type | hollow split type | hollow split type | hollow split type | hollow split type | hollow split type | hollow split type |
| Polyester Volume Ratio | 0.5 | 0.5 | 0.5 | 0.4 | 0.6 | 0.5 | PP volume ratio: 0.5 |
| Spinning Temp. (° C.) | 280 | 280 | 280 | 280 | 280 | 280 | 280 |
| Spinnability | A | A | A | B | B | C | A |
| Physical Properties of Splittable Conjugate Fiber | | | | | | | |
| Single-Yarn Fineness (dtex/f) | 3.3 | 3.3 | 3.3 | 3.3 | 3.3 | (4.6) ** | 5.0 |
| Single-Yarn Strength (cN/dtex) | 1.8 | 1.4 | 1.4 | 1.5 | 1.5 | (1.6) ** | 5.6 |
| Elongation (%) | 19 | 49 | 46 | 36 | 41 | (29) ** | 75 |
| Configuration of Conjugate Fiber | | | | | | | |
| Content * | 70 | 80 | 80 | 95 | 60 | (20) ** | 60 |
| W/R | 0.40 | 0.35 | 0.38 | 0.24 | 0.50 | (0.60) ** | 0 |
| Area Ratio Z | 0.5 | 0.5 | 0.5 | 0.4 | 0.6 | (0.5) ** | PP area ratio: 0.5 |
| Z/(W/R) | 1.3 | 1.4 | 1.3 | 1.7 | 1.2 | (0.8) ** | — |
| Unexposed Ratio (%) | 25 | 23 | 28 | 56 | 14 | (9) ** | 8 |
| Physical Properties of Form | | | | | | | |
| Texture | A | A | A | A | A | (B) ** | A |
| Air Permeability ($cc/cm^2/sec$) | 72 | 64 | 67 | 58 | 73 | (79) ** | 138 |

Note:
* The proportion of splittable conjugate fibers having a cross-sectional configuration, in which at least one of polyester segments extends to an outer edge of the fiber and at least one of polyester segments extends to a point lying within the outer edge of the fiber, in the fiber aggregate.
** The figures in the parentheses are only for reference because of the small amount of samples.

In Examples 1 through 6, since the splittable conjugate fiber of the invention are highly thermobondable to a polyolefin-based binder fiber, the texture thereof after splitting is excellent as well as the splittable conjugate fiber comprising two kind of polyolefins used in Comparative Example 1. The splittable conjugate fibers of the invention (Examples 1 to 6) have superior splittability to those of Comparative Example 1 under the same splitting conditions, as is proved by the lower air permeability of the resulting fibrous forms. To put it another way, the splittable conjugate fiber of the invention easily splits into microfibers without requiring strict conditions as have conventionally been used. Therefore, even in a nonwoven fabric with relatively low base weight, splitting of fibers can be accomplished without causing disturbance of the texture. This leads to considerable saving of time and cost of a splitting operation such as a treatment with high pressure liquid jets.

The aggregates of splittable conjugate fiber of Examples 1 to 5 are preferred to that of Example 6 owing to the excellent spinnability.

The present application is based on Japanese Patent Application No. 2007-137994 filed on May 24, 2007, and the contents are incorporated herein by reference.

INDUSTRIAL APPLICABILITY

The present invention provides a splittable conjugate fiber comprising a polyester and a polyolefin, which is excellent in thermal bondability to a polyolefin-based binder fiber or the like, splittability, and productivity; an aggregate of the splittable conjugate fibers; and a fibrous form made from the splittable conjugate fibers. The splittable conjugate fiber comprising the polyester and the polyolefin and an aggregate thereof of the present invention exhibit high thermal bondability to a polyolefin-based binder fiber as well as good splittability, and are therefore easy to split fibers to provide a fibrous form with high denseness and good texture.

The invention claimed is:

1. A splittable conjugate fiber comprising a polyester segment and a polyolefin segment, wherein the splittable conjugate fiber comprises two or more parts of the polyester segment extending from a center of the fiber toward an outer edge of the fiber in a cross-sectional configuration perpendicular to its longitudinal direction, in which at least one of the two or more parts of the polyester segment extending from the center of the fiber toward the outer edge of the fiber is exposed at the outer edge of the fiber and at least one of the two or more parts of the polyester segment extending from the center of the fiber toward the outer edge of the fiber is unexposed at the outer edge of the fiber.

2. The splittable conjugate fiber according to claim 1, wherein a center of the splittable conjugate fiber is hollow.

3. The splittable conjugate fiber according to claim 1, which has a value of W/R of 0.1 to 0.4, wherein W represents a length of an arc of the polyester segment and R represents a length of a circumference of the fiber.

4. An aggregate of splittable conjugate fibers comprising polyester and polyolefin, which comprises the splittable conjugate fiber according to claim 1 in a proportion of at least 25% based on a total number of the splittable conjugate fibers contained in the aggregate.

5. A fibrous form comprising a microfiber having an average single-yarn fineness of 0.6 dtex or less, wherein the fibrous form is obtained by splitting the splittable conjugate fiber according to claim 1.

6. A fibrous form comprising a microfiber having an average single-yarn fineness of 0.6 dtex or less, wherein the fibrous form is obtained by splitting the splittable conjugate fibers contained in the aggregate according to claim 4.

* * * * *